United States Patent [19]

Bar-on et al.

[11] 4,156,524

[45] May 29, 1979

[54] ROLL FUSER STRIPPING MECHANISM

[75] Inventors: Ari Bar-on, Rochester; Louis R. Hattler, Marion, both of N.Y.

[73] Assignee: Xerox Corporation, Stamford, Conn.

[21] Appl. No.: 809,213

[22] Filed: Jun. 23, 1977

[51] Int. Cl.[2] ..... B65H 29/54

[52] U.S. Cl. ..... 271/174; 118/60; 118/245; 432/60; 271/DIG. 2

[58] Field of Search ..... 271/174, DIG. 2; 118/60, 245; 432/60; 100/174

[56] References Cited

U.S. PATENT DOCUMENTS 3,885,786 5/1975 Schmalzbauer ..... 271/174

OTHER PUBLICATIONS

Xerox Disclosure Journal, "Sheet Removal Device for Fuser Rolls", Gustavo De Nicola et al., vol. 1, No. 2, Feb. 1976, pp. 35, 36.

*Primary Examiner*—Richard A. Schacher

[57] ABSTRACT

Sheet stripping mechanism for effecting removal of copy sheets, having toner images substantially fused thereto, from a heated fuser member forming a part of a xerographic or the like, reproducing apparatus. The sheet stripping mechanism is characterized by the provision of a stripping blade which is substantially coextensive with the dimension of the copy sheet to be stripped from the fuser member. The blade is attached to a pivotal support structure by means of a heat insulating block interposed between the blade and the pivotal support. A pair of springs serve to bias the blade into contact with the heated fuser member, the pivot point of support members being in line with the plane of the blade whereby the blade during stripping is substantially tangential to the surface of the heated fuser member.

4 Claims, 3 Drawing Figures

ROLL FUSER STRIPPING MECHANISM

BACKGROUND OF THE INVENTION

This invention relates to an electrostatographic printing machine, and more particularly concerns an apparatus for separating a sheet of support material from a heated fuser member employed in the printing machine.

In a typical electrostatographic printing machine, a latent image is recorded on a surface and developed with charged particles. After the latent image is developed, a sheet of support material is positioned closely adjacent thereto so as to receive the particles therefrom. The particles are then permanently affixed to the sheet of support material forming a copy of the original document thereon. Electrographic and electrophotographic printing are differing versions of electrostatographic printing. The process of electrophotographic printing employs a photoconductive member arranged to be charged to a substantially uniform level. The charged photoconductive member is exposed to a light image of an original document. The light image irradiates the charged photoconductive member dissipating the charge in accordance with the intensity of the light transmitted thereto. This records an electrostatic latent image on the photoconductive surface. Electrographic printing differs from electrophotographic printing in that neither a photoconductive member nor a light image of the original document are required to create a latent image on the surface. Both of the foregoing processes generally employ heat settable particles to develop the latent image. The particles are permanently fused to the sheet of support material by the application of heat thereto.

Various techniques have been developed for applying heat to the particles on the sheet of support material. One technique is to pass the sheet of support material with the powder image thereon through a pair of opposed rollers. In one such system, a heated fuser roll and a non-heated backup roll are employed.

In the most commonly employed type of heated roll fuser, the heated fuser roll has the outer surface thereof covered with a polytetrafluorethylene commonly known as Teflon to which a release agent such as silicone oil is applied. The Teflon layer, preferably, has a thickness of about several mils.

Teflon coated fuser rolls of the type discussed above have been found unsuitable for fusing high powder height toner images such as those formed in a color printing process such as will be discussed hereinafter. Accordingly, an alternate approach to fusing toner images by means of a heated roll system comprises utilization of a of metal heated roll which has a low molecular weight polyethylene applied thereto as a release agent. While such a roll construction satisfactorily fuses the toner images formed during a color reproduction process utilizing different colored toners, it has been found that conventional stripping means such as individual stripping fingers do not satisfactorily strip the copy paper from the heated fuser roll member.

Accordingly, it is the primary object of the present invention to improve the apparatus employed to separate the sheet of support material from the fuser member utilized in a color copier of the xerographic type.

SUMMARY OF THE INVENTION

Briefly, the above-cited objects are accomplished by the provision of a stripping blade which is coextensive with the copy sheet to be stripped from a heated fuser member. The blade is pivotably supported such that it tangentially contacts the heated fuser member and has a very thin leading edge which rides on the fuser member and becomes interposed between the fuser member and the leading edge of the copy paper thereon. The blade is supported by pivot pins which pins are located in line with or below the blade to thereby effect the aforementioned tangential relationship between the blade and the fusing roll member. It has been found that if the pivot point is above a line drawn through a plane tangent to the fuser at the point of contact with stripping blade the leading edge of the blade will raise up off the fuser roll and cause misfeeding of the copy paper after it is stripped from the fuser roll.

Other objects and advantages of the present invention will become apparent upon reading of the description of the preferred embodiments with reference to the drawings in which.

Figure 1:
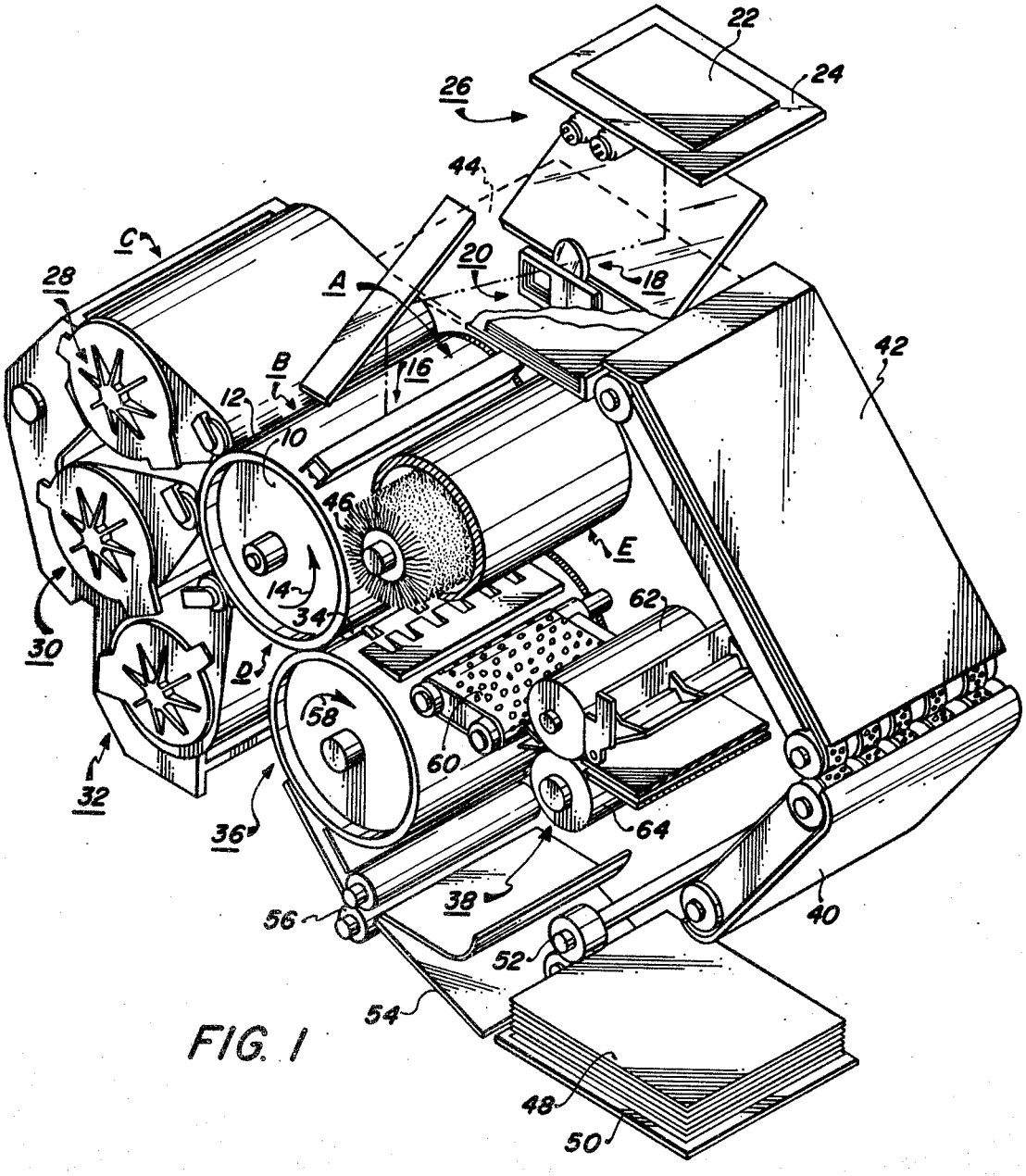
FIG. 1 is a schematic perspective view of an electrophotographic printing machine having the present invention incorporated therein.

FIG. 1 schematically illustrates an electrophotographic printing machine arranged to produce multicolor copies from a color original. As shown therein the machine employs a photoconductive member having a rotatably mounted drum 10 with a photoconductive surface 12 thereon. Drum 10 rotates in the direction indicated by arrow 14 to move photoconductive surface 12 through a series of processing stations A through E, inclusive.

Initially, drum 10 rotates photoconductive surface 12 through charging station A which has a corona generating device, indicated generally by the reference numeral 16, positioned thereat. Preferably, corona generating device 16 extends transversely across photoconductive surface 12 and is arranged to charge surface 12 to a relatively high uniform potential A suitable corona generating device is described in U.S. Pat. No. 2,778,946 issued to Mayo in 1957.

Charged photoconductive surface 12 next rotates to exposure station B wherein a moving lens system indicated generally at 18, and a color filter mechanism, depicted generally at 20, are positioned. One type of moving lens system suitable for the electrophotographic printing machine of FIG. 1 is disclosed in U.S. Pat. No. 2,062,108 issued to Mayo in 1962. As illustrated in FIG. 1, a colored original document 22 is stationarily supported face down upon transparent viewing platen 24. In this manner, successive incremental areas of original document 22 are illuminated by a moving lamp assembly, indicated generally at 26. Lamp assembly 26 and lens system 18 are moved in a timed relation with drum 10 to produce a flowing light image of original document 22 on photoconductive surface 12. The resultant image produced on photoconductive surface 12 is termed an electrostatic latent image. The electrophotographic printing machine depicted in FIG. 1 is arranged to interpose selected colored filters in the optical path of lens 18 via filter mechanism 20. Preferably, filter mechanism 20 operates on the light rays transmitted through lens 18 to record an electrostatic latent image on photoconductive surface 12 corresponding to a preselected spectral region of the electromagnetic wave spectrum, i.e. a color separated electrostatic latent image. In this manner, an electrostatic latent image is produced on photoconductive surface 12 which corresponds to a single color of original document 22.

Subsequent to the recording of the color separated electrostatic latent image on photoconductive surface 12, drum 10 rotates to development station C having three individual developer units, generally indicated by the reference numerals 28, 30 and 32, respectively, located thereat. The developer units depicted in FIG. 1 are all magnetic brush type developer units. In a magnetic brush development system, a magnetizable developer mix having carrier granules and toner particles is continually brought through a directional flux field to form a brush of developer mix. A suitable development system utilizing a plurality of developer units is disclosed in U.S. Pat. No. 3,854,449 issued to Davidson in 1974. Development is achieved by contacting photoconductive surface 12 with the brush of developer mix. Developer units 28, 30 and 32, each apply toner particles corresponding to the complement of the color separated latent image recorded on photoconductive surface 12. For example, developer units 28 deposits cyan toner particles on a red filtered latent image, developer unit 30 deposits magenta toner particles on a green filtered latent image, and developer unit 32 deposits yellow toner particles on a blue filtered latent image. The aforementioned steps of depositing various color toner particles on the respective electrostatic latent images occurs sequentially rather than simultaneously.

After development, the toner powder image electrostatically adheres to photoconductive surface 12 and moves therewith to transfer station D. At transfer station D the powder image is transferred to a sheet of final support material 34 by means of a biased transfer roll, shown generally at 36. U.S. Pat. No. 3,612,677 issued to Langdon in 1972 discloses a suitable electrically biased transfer roll. Transfer roll 36 is biased electrically to a potential such that the magnitude and polarity thereof is sufficient to attract electrostatically the toner powder image from photoconductive surface 12 to support material 34. A single sheet of support material 34 is supported on transfer roll 36. Bias transfer roll 36 is arranged to recirculate the sheet of support material 34 in synchronism with the rotation of drum 10. In this manner, the toner powder images developed on photoconductive surface 12 are transferred, in superimposed registration, to sheet 34. Hence, it is apparent that in a multi-color electrophotographic printing of the type depicted in FIG. 1, the aforementioned steps of charging, exposing, developing and transfer are repeated for a plurality of color separated light images in order to form a composite picture of the original document corresponding in color thereto.

After the last transfer operation, support sheet 34 is stripped from bias transfer roll 36. Conveyor 60 advances sheet 34 to a fuser, shown generally at 38, where the multi-layered toner powder image is coalesced and permanently affixed thereto. Fuser 38 will be discussed hereinafter in conjunction with FIG. 2 and 3 in greater detail. After the multilayered toner powder image is coalesced to support material 34, endless conveyor belts 40 and 42 advance support material 34 to catch tray 44 for subsequent removal by the machine operator.

Cleaning station E is the last processing station in the direction of rotation of drum 10, as indicated by arrow 14. Cleaning station E has positioned thereat a rotatably mounted fibrous brush 46 which engages photoconductive surface 12 to remove residual toner particles remaining thereon after the transfer operation. Preferably, fibrous brush 46 is of the type described in U.S. Pat. No. 3,590,412 issued to Gerbasi in 1971.

It should be noted that support material 34 may be plain paper or a transparent thermoplastic sheet, amongst others, which is advanced from a stack 48 mounted on tray 50. Feed roll 52 separates and advances the uppermost sheet from stack 50 into a baffle arrangement 54. Baffle 54 guides the advancing sheet into the nip of a pair of register rolls which align the sheet and pass it therebetween such that it is releasably secured to bias transfer roll 36. Bias transfer roll 36 is arranged to rotate in the direction of arrow 58 moving support material 34, releasably secured thereto, in a recirculating path such that successive toner images are transferred thereto in superimposed registration with one another forming a multilayered toner powder image.

Figure 2:
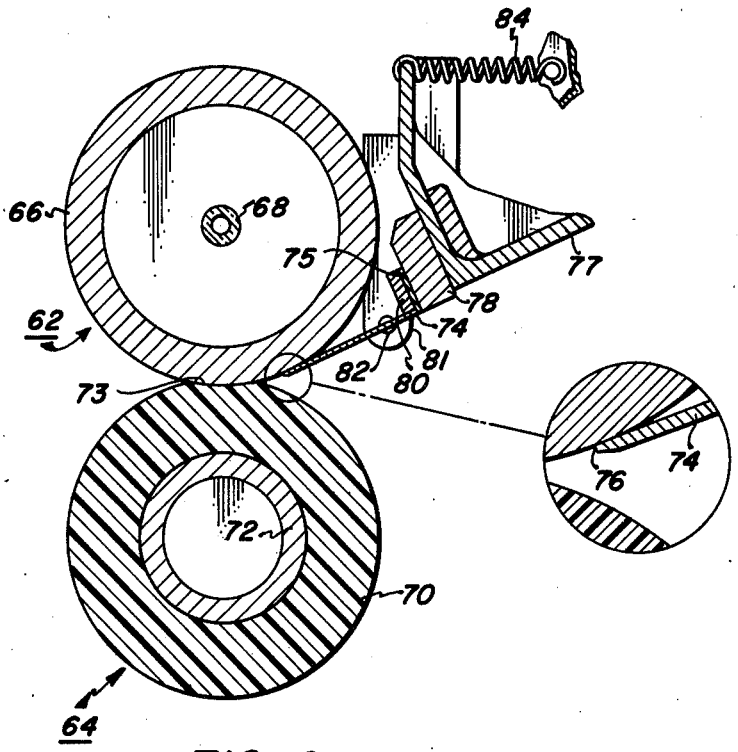
FIG. 2 is an end view of a roll arrangement fusing pair and blade stripping means for effecting removal of copy sheets from the heated fuser member constituting one of the rolls of the roll pair.

Referring now to FIG. 2, there is shown a side elevational view of the fuser 38 utilized in the electrophotographic printing machine of FIG. 1. The fuser is depicted in FIG. 2 as having an upper heated roll 62 and a lower backup or pressure roll 64. Conveyor 60 is associated with the fuser to transport support material 34 from transfer roll 36 thereto.

The fuser roll 62 comprises a hollow metal core 66 preferably fabricated from aluminum or copper and a resistance heating element 68 disposed internally of the core 66 in a conventional manner (not shown). When the core is aluminum it is preferably provided with a steel sleeve (not shown). The backup roll 64 comprises a layer of resilient material, for example, silicone rubber or a fluoroelastomer such as Viton applied to a metal core 72. The resilient layer 70 is such that when pressure is applied to effect engagement of the rolls 62 and 64 the roll 62 being harder causes a depression in the resilient layer 70 to thereby form a nip 73 having a 0.312 nominal dimension through which the copy paper passes with the toner images thereon contacting the surface of the fuser roll.

A release agent material such as low molecular weight polyethylene may be applied to the surface of the fuser roll in order to minimize offsetting of toner to the surface of the roll as well as reducing the force required to strip the copy paper from the fuser roll.

In order to strip the copy paper from the fuser roll to preclude wrapping of the copy paper around the fuser roll thereby causing a paper jam necessitating shutting down of the copier apparatus, a stripper blade 74 is provided.

The blade 74 is provided with a flange portion 75 utilized for mounting the blade in a manner to be discussed hereinafter, and a leading edge portion 76. The nominal thickness of the blade material is 0.010 inch while the edge 76 has a nominal thickness of 0.0005. As mentioned hereinabove, the blade is attached to a support 77 which comprises a cast aluminum frame member. In order to minimize the transfer of heat from the stripper blade 74 an insulating block 78 is interposed between the flange 75 of the blade and the aluminum support 77.

The blade is clamped to the insulating block by means of a flat metal piece 80 which is attached to the insulating block by suitable fasteners (not shown). The blade is provided with a thin coating of polyfluoroethylene to prevent toner backup thereon.

The entire assembly including the support 77, blade 74, and insulating block and clamp 80 is supported adjacent the fuser roll member 62 by a plurality of pivot arms 81 and pivot pins 82 such that the blade can be biased into engagement with the fuser roll to thereby establish a suitable pressure or force therebetween, for example, 10 pounds. A pair of bias springs 84 are provided which accomplish the clockwise rotation of the assembly about the pivot pins 82.

As shown in the drawings, particularly FIG. 2, the pivot pins 82 are directly in line with the plane of the stripping blade.

If the pivot position is above the plane then the blade edge is forced out of contact with the fuser roll surface.

Figure 3:
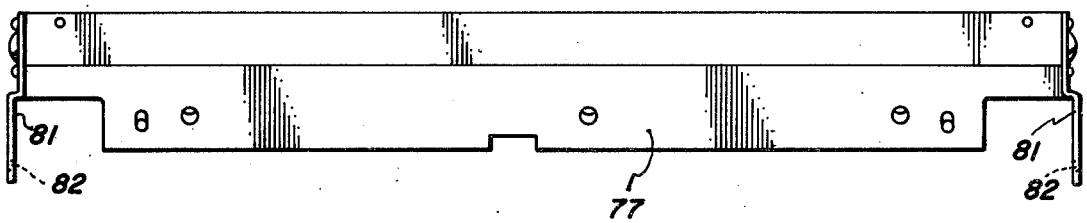
FIG. 3 is a top plan view of a stripping blade holder or support.

The blade as shown in FIG. 3 is a rather long member such length being substantially coextensive with the dimension of the copy paper to be stripped from the fuser roll.

While the invention has been described in accordance with the preferred embodiment thereof it will be appreciated that various modifications thereto will become apparent and it is therefore intended that such modifications be covered by the claims appended hereto.

What is claimed is:

1. In a heat and pressure roll fusing apparatus for fusing toner images to copy paper wherein a heated roll and a backup roll form a nip through which copy paper having toner images thereon is passed with the toner images contacting the heated roll, the improvement comprising:

means for effecting separation of said copy paper from said heated roll including:

an elongated blade member;

support means for supporting said blade member;

means for pivotally mounting said supporting means;

means for biasing said support member such that said blade member contacts said heated roll tangentially at the lead edge of said blade;

said means for pivotably mounting said support member being directly in line with the plane occupied by said blade whereby the portion of said blade contacting said heated roll is substantially tangent thereto.

2. Apparatus according to claim 1 wherein said blade has a relatively low mass.

3. Apparatus according to claim 2 including heat insulating means interposed between said blade and said support to thereby minimize thermal effects on said blade.

4. Apparatus according to claim 3 wherein said blade is coated with polytetrafluoroethylene.

* * * * *